US009814260B2

(12) United States Patent
Krasnov et al.

(10) Patent No.: US 9,814,260 B2
(45) Date of Patent: Nov. 14, 2017

(54) CIGARETTE HOLDER

(71) Applicants: Yuriy K Krasnov, Lyndhurst, OH (US); Yuriy Y Krasnov, Lyndhurst, OH (US)

(72) Inventors: Yuriy K Krasnov, Lyndhurst, OH (US); Yuriy Y Krasnov, Lyndhurst, OH (US)

( * ) Notice: Subject to any disclaimer, the term of this patent is extended or adjusted under 35 U.S.C. 154(b) by 283 days.

(21) Appl. No.: 14/545,579

(22) Filed: May 26, 2015

(65) Prior Publication Data

US 2016/0345624 A1 Dec. 1, 2016

(51) Int. Cl.
*A24F 13/04* (2006.01)

(52) U.S. Cl.
CPC ..... *A24F 13/04* (2013.01)

(58) Field of Classification Search
CPC ..... A24F 13/02; A24F 13/04; A24F 7/00
See application file for complete search history.

(56) References Cited

U.S. PATENT DOCUMENTS 2,385,651 A * 9/1945 Ricketts ..... A24F 1/00 131/182
2,580,523 A * 1/1952 Crone ..... A24F 13/14 131/175
2,954,780 A * 10/1960 Lebert ..... A24F 13/04 131/187
3,196,881 A * 7/1965 Walters ..... A24F 13/04 131/198.2
3,354,888 A * 11/1967 Parrigin ..... A24F 13/04 131/202
3,468,316 A * 9/1969 Baum ..... A24D 3/045 131/187
3,506,018 A * 4/1970 Petrino ..... A24F 13/04 131/194
3,593,723 A * 7/1971 Nishida ..... A24F 13/02 131/199
3,631,866 A * 1/1972 Bottazzi ..... A24F 13/04 131/210
3,636,960 A * 1/1972 Blount ..... A24F 13/04 131/187
3,867,952 A * 2/1975 Fujimura ..... A24F 13/04 131/333
3,888,263 A * 6/1975 Blanchard ..... A24F 1/08 131/201
3,926,199 A * 12/1975 Thomas ..... A24F 13/04 131/187
4,049,005 A * 9/1977 Hernandez ..... A24F 13/04 131/187
4,517,989 A * 5/1985 Mensik ..... A24F 13/06 131/187
4,852,590 A * 8/1989 Ferka ..... A24F 13/04 131/198.1
5,353,813 A * 10/1994 Deevi ..... A24F 47/008 131/194
6,006,823 A * 12/1999 Kiknadze ..... F15D 1/005 165/133
6,318,376 B1 * 11/2001 Cheng ..... A24F 13/04 131/173

(Continued)

*Primary Examiner* — Jacob T Minskey
*Assistant Examiner* — Taryn T Willett

(57) ABSTRACT

The present invention describes the cigarette holder with advanced smoking effect.
The invented cigarette holder offers the means for making a full draw of the low temperature smoke into the lungs using minimal suction effort.

20 Claims, 8 Drawing Sheets

(56) References Cited

U.S. PATENT DOCUMENTS

| | | | | |
|---|---|---|---|---|
| 8,616,218 | B2 * | 12/2013 | Koshiishi | A24C 5/44 131/201 |
| 8,955,521 | B1 * | 2/2015 | Hanson | A24F 1/00 131/329 |
| 2016/0021929 | A1 * | 1/2016 | Sawalha | A24F 47/002 131/329 |

* cited by examiner

CIGARETTE HOLDER

BACKGROUND OF THE INVENTION

1. Field of the Invention

The present invention relates generally to an apparatus for and the method of smoking of cigarettes.

2. Description of the Related Art

The difficulty of creating of a balance between the natural ability of human lungs to create the pressure drop and desired dosage of smoke intake while inhaling has always been the biggest problems of smoking. The main factor that is causing just said problem is the temperature of the smoke. From the point of view of Physics, the peculiarity of the smoking process is evident: the same suction effort of smoker that provides a flux of ambient air used to burn certain amount of a smoke-producing material is also used to carry the produced hot smoke directly into the person's lungs.

Delivery of hot gases into the lungs does not only cause a very unpleasant burning sensation and sometimes coughing, but also, according to the majority of modern medical studies, is the main cause of destructive effect that smoking imposes to the human's mouth and lungs. Therefore, the problem of decreasing of the temperature of the hot smoke right at the moment of inhaling is the very important goal and the technical challenge.

The history of cigarette holders, pipes, mouthpieces, and other smoking devices is as old as the modern human history itself. There is a tremendous variety of smoking devices across the world, including those that were created specifically with the purpose of solving the problem of reducing the temperature of the smoking fumes. It is fair to say that each generation of engineers of the modern era in each new phase of progress has contributed its own solutions for the above stated problem. Present invention is one more step in this direction.

Smokers say: "Smoking brings joy", but Surgeon General warns: "Traditional smoking can kill". Let smokers be smart and start smoking in a Hi-tech fashion, preventing, at least, the lungs burning that could be caused by a hot smoke.

SUMMARY OF THE INVENTION

It is the object of present invention to teach the means of using Vortical Boiling Phenomenon of heat exchange at the convective cooling for cooling of smoke inside the cigarette holder up to full recuperation with the temperature of the human body before this smoke has reached the smoker's lungs. The invented cigarette holder offers the means for making a full draw of the desired dosage of smoke into the lungs using minimal suction effort at a fully recuperated temperature's excess over the normal of human body temperature.

Indeed, when trying to reach the maximum smoking effect a one needs to inhale as much smoke as possible. The only obstacle is the limited flow of air intentionally restricted by any existing smoking device.

Examples: Restricted airways in a regular pipe and a cigarette holder; multiple compartments and water layer in Hookah; multiple compartments and suction steps in Bong, etc. All these airflow limiting designs exist for a single purpose only: preventing access of hot smoke into the human lungs.

The present invention depicts the cigarette holder, which eliminates the need for restrictive airflow by cooling the hot smoke to the human body temperature, thus allowing bigger draw of smoke into the lungs and holding it in for longer period of time, and therefore increasing the smoking effect.

The full recuperation of smoke's temperature to the human body temperature level is achieved by implementation of the Vortical Boiling regime of flow used in U.S. Pat. No. 8,496,048 B2. The Vortical Boiling regime of the flow of smoke inside of the cigarette holder is generated by the dense regular triangular lattice of segmental dimples that forms streamlined surfaces of the cigarette holder.

BRIEF DESCRIPTION OF THE DRAWINGS

Advantages and features of the present invention are better understood with reference to the following more detailed description and claims taken in conjunction with accompanying drawings:

All other figures show the composition of said cigarette holder of the two identical half-cylindrical external walls, the central core, the entrance cover and the mouthpiece.

Figure 2:
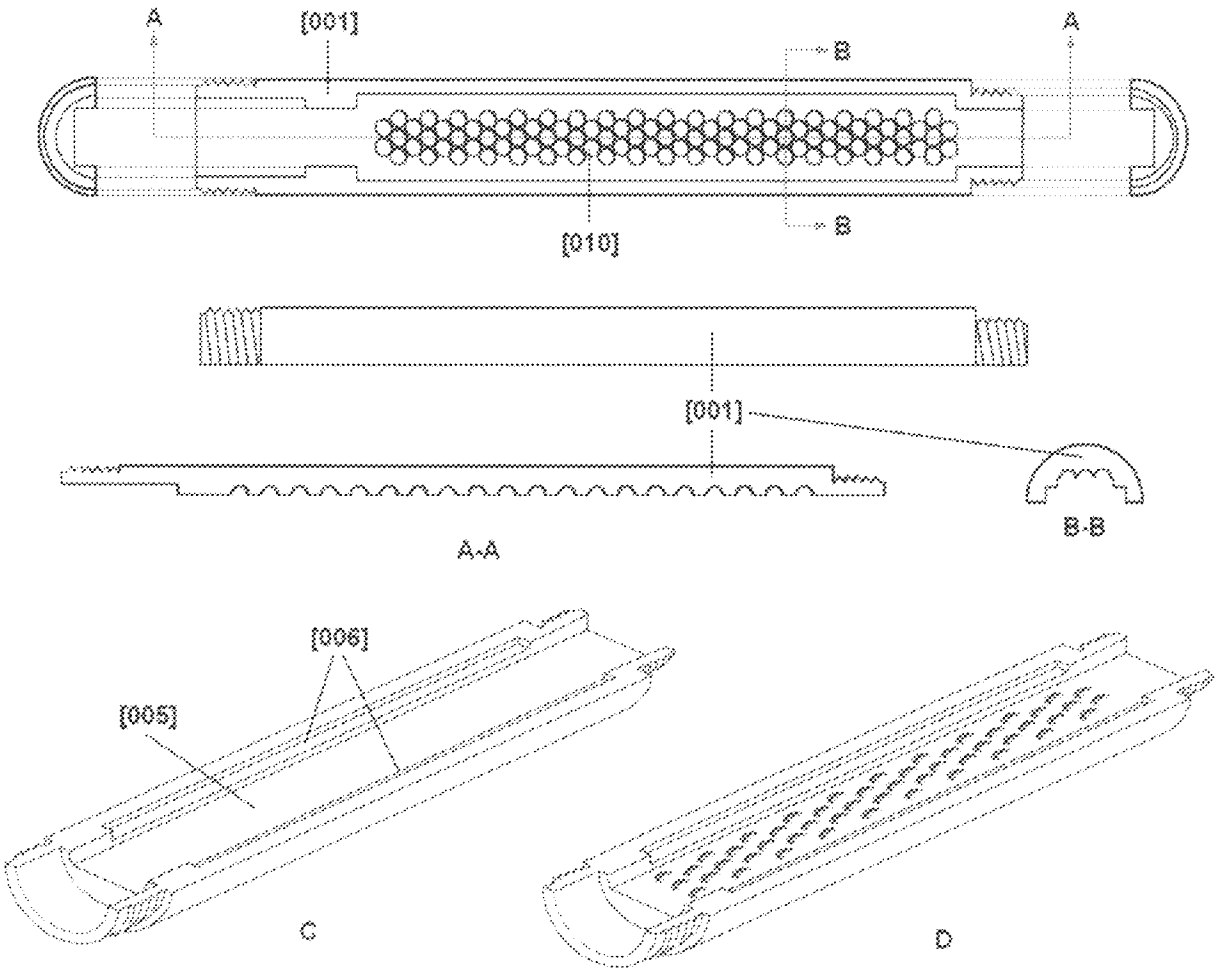

FIG. 2 shows the schematics of the half-cylindrical external wall of the invented cigarette holder.

Figure 3:
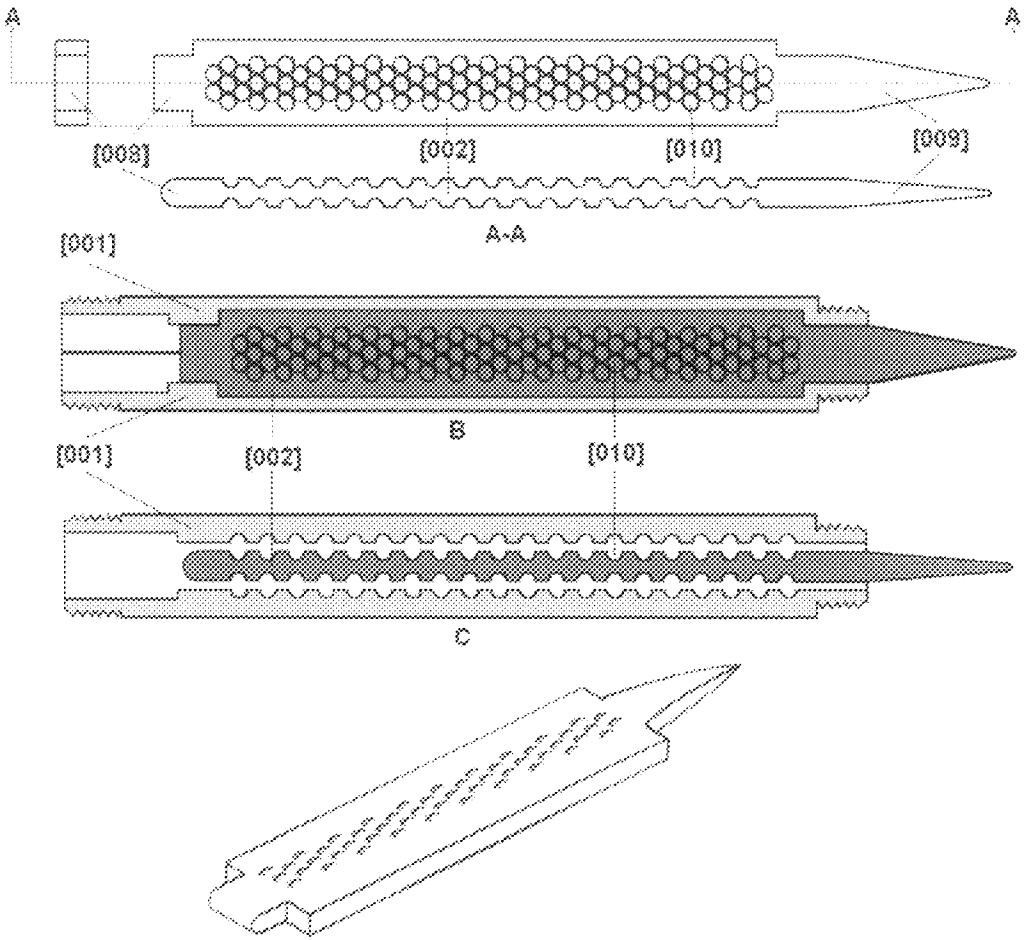

FIG. 3 shows the schematics of the central core of the invented cigarette holder.

Figure 4:
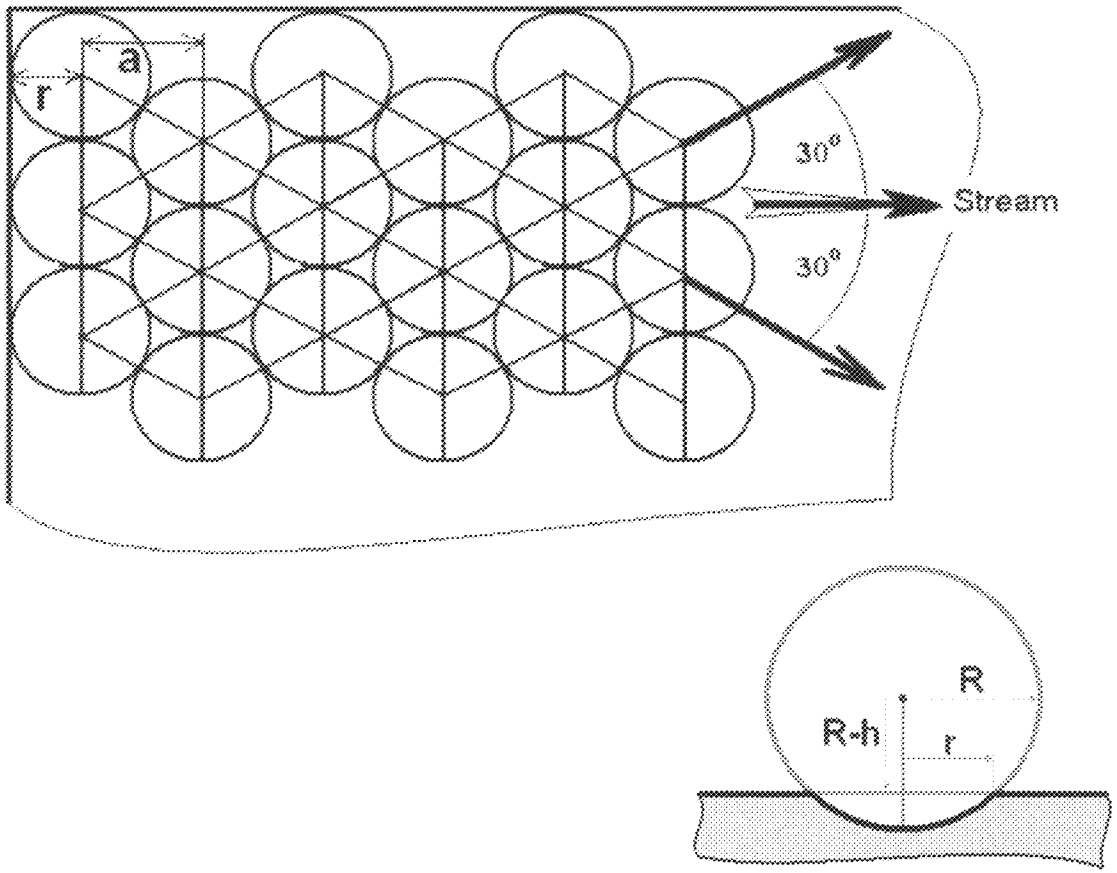

FIG. 4 shows the schematics of the dense triangular lattice of segmental dimples.

Figure 5:
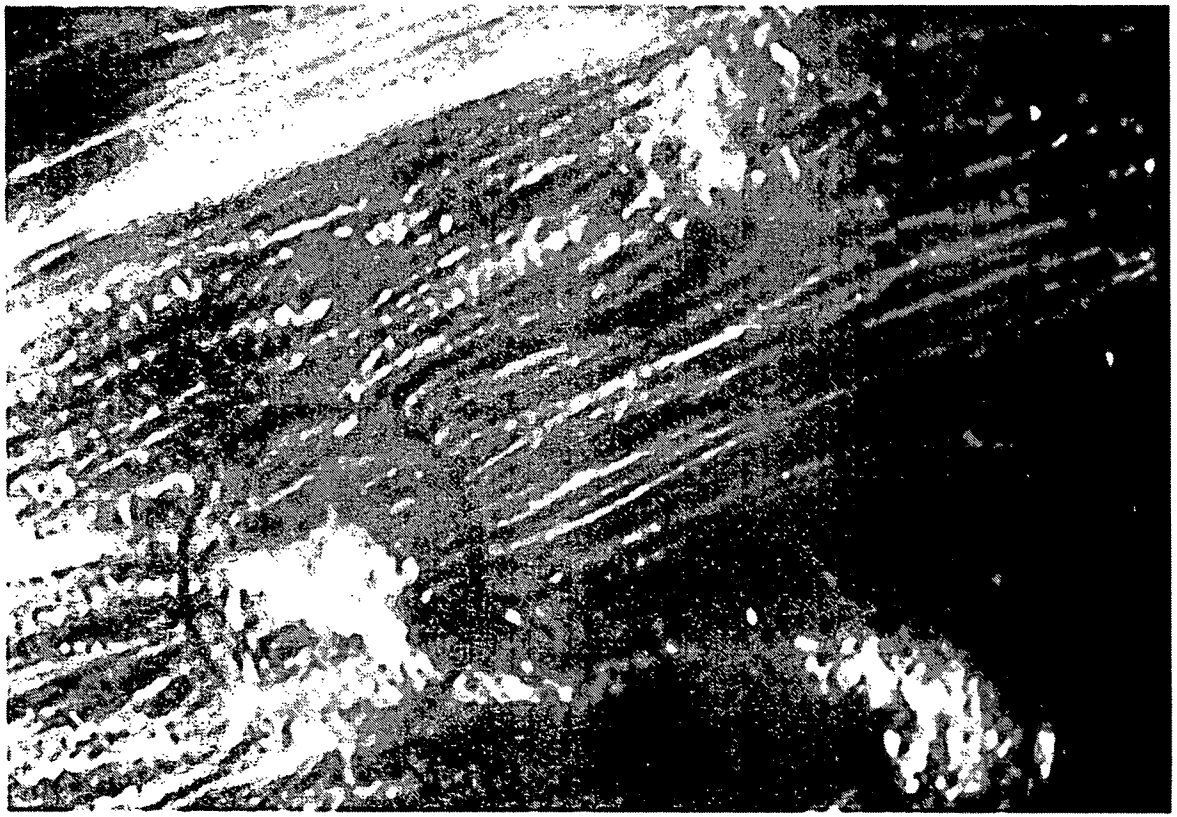

FIG. 5 shows an example of a well-developed Vortical Boiling regime of flow over a surface that is modified with the dense triangular lattice of segmental dimples.

Figure 6:
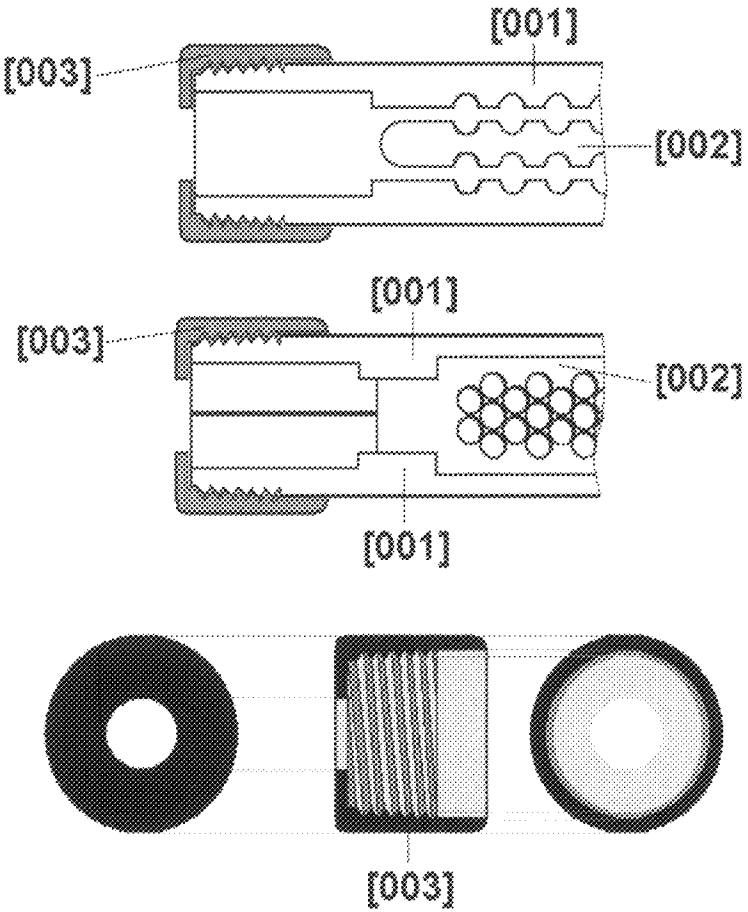

FIG. 6 shows the schematics of the entrance cover of the invented cigarette holder.

Figure 7:
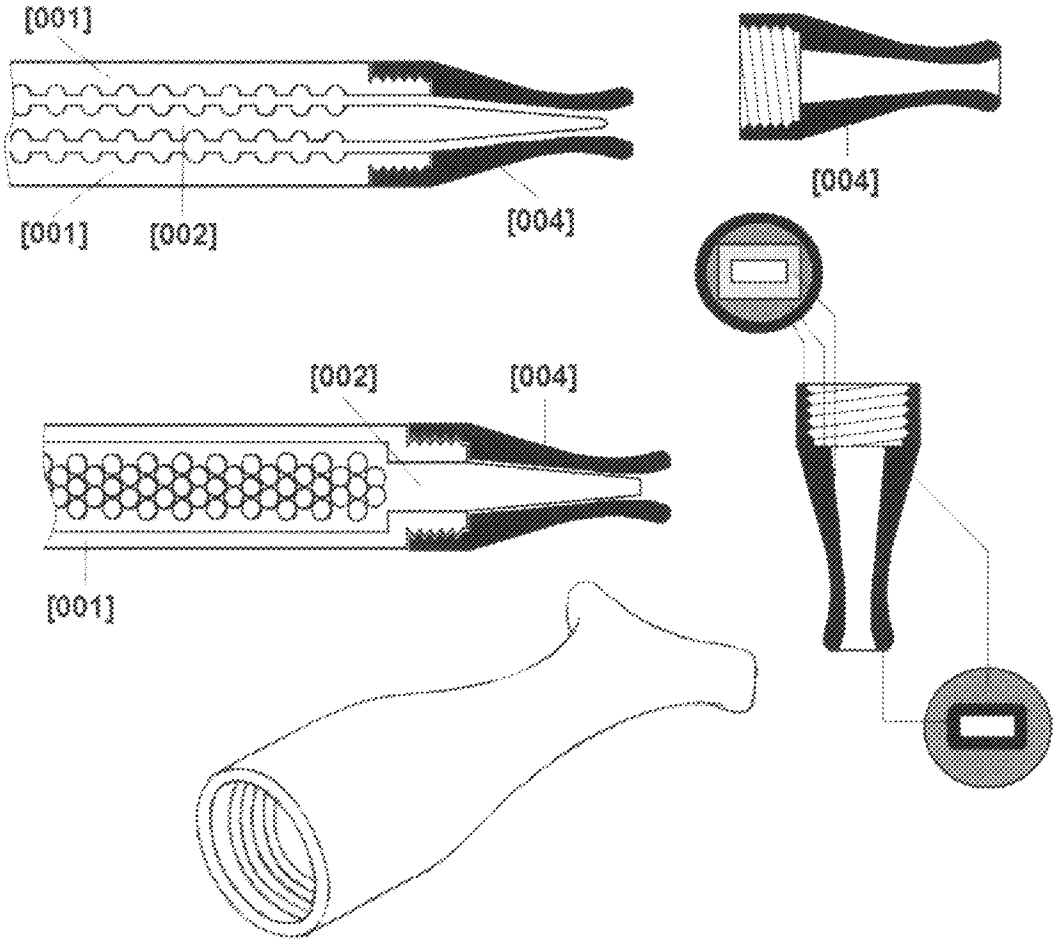

FIG. 7 shows the schematics of the mouthpiece of the invented cigarette holder.

Figure 8:
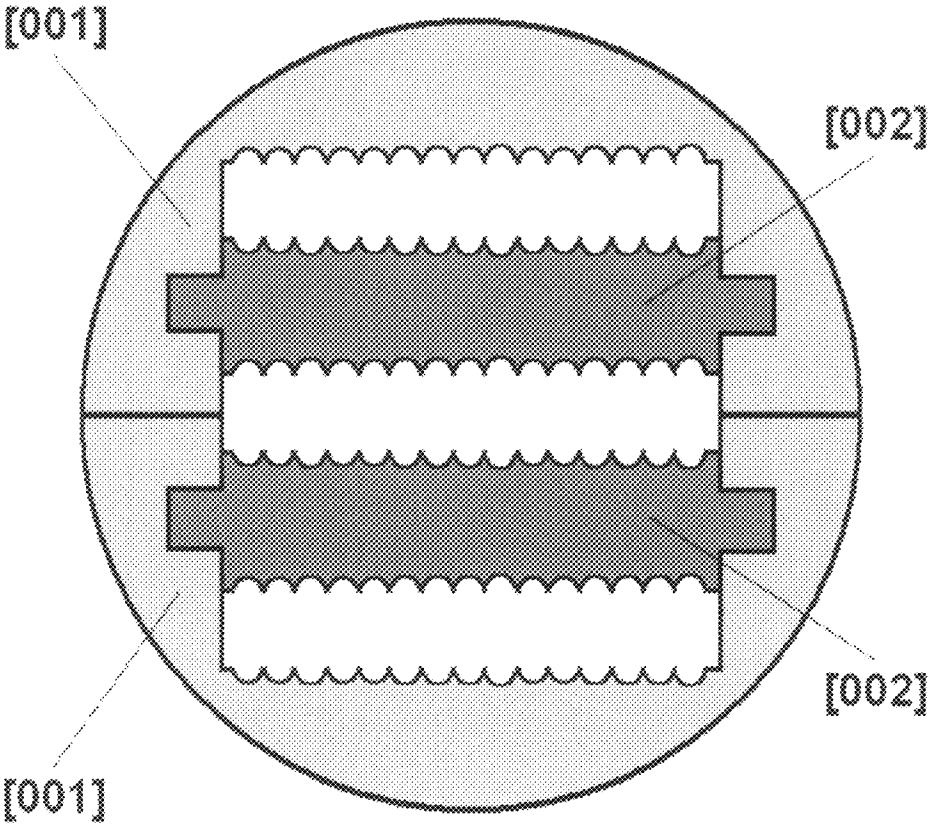

FIG. 8 shows the schematics of the multichannel cigarette holder.

DESCRIPTION OF THE PREFERRED EMBODIMENT

Figure 1:
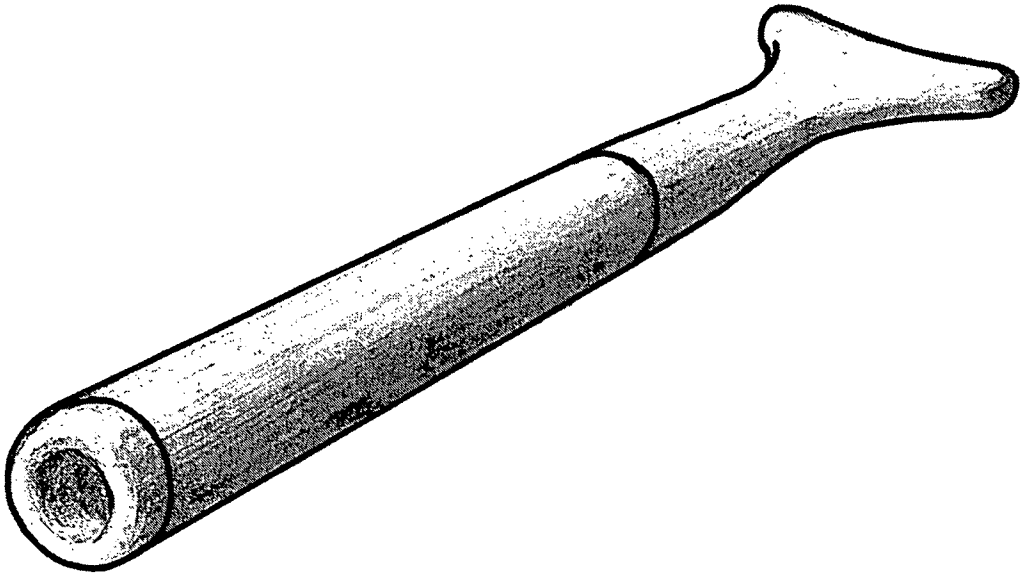
FIG. 1 shows the picture of the image of the embodied cigarette holder.

The common view of the preferred embodiment of the present invention is shown in FIG. 1. FIG. 2 represents the preferred embodiment as a body comprising five parts: two identical half-cylindrical external walls [001], the central core [002], the entrance cover [003] and the mouthpiece [004].

FIG. 2 shows the drawings of the side half-wall [001] of the invented cigarette holder in details. As one can see, this part is made of an aluminum half-cylinder (although steel, brass, bronze, cooper, silver, gold, platinum and their alloys with high heat and thermal conductivity can be used).

A rectangular piece of the material is cut out off of said half-cylinder, so that inside it there the symmetric flat rectangular central notch [005] all along said half-cylinder is made.

On the center of sides of said rectangular central notch [005] there are made other, smaller and shorter, flat side rectangular notches [006].

The one half-cylindrical external wall [005] can be attached to the second half-cylindrical external wall [001] so that the obtained body will represent a cylindrical carcass of the invented cigarette holder: the cylindrical tube having a rectangular hole [011] all along it with two doubled side rectangular notches [012] inside, as it is shown in FIG. 2.

The bottom and top surfaces of said rectangular central hole that are actually assembled of two half-cylindrical external walls [001] are modified with the dense triangular lattice of the segmental dimples.

FIG. 3 shows the schematics of the central core [002] of the invented cigarette holder in details. The central core [002] of the invented cigarette holder is a body, which has a rectangle normal cross-section in every point along its length, and is made of the aluminum (although steel, brass, bronze, cooper, silver, gold, platinum and their alloys with high heat and thermal conductivity can be used). Said core can be considered as body having three parts: central part and two identical strictly rectangular "wings" [007]: one from the left side of said central part and another one from the right side of said central part. The dimensions of said "wings" should be chosen to make each "wing", being entirely placed in the doubled side rectangular notch of the described cylindrical carcass of the invented cigarette holder, to completely fill said side rectangular notch.

The wide of the central part of the core [002] should be chosen to provide reliable contact with the half-cylindrical external walls [001] of the described cylindrical carcass of the invented cigarette holder in every point of the side surfaces of the core.

Core [002] begins with a rounded "nose" [008] and ends with gradually decreasing "tail" [009] that is providing a low turbulization of the stream of smoke at the streamlined core. The top and bottom surfaces of said central part of the core are modified with the dense triangular lattice of the segmental dimples [010].

The height of the central core [002] should be chosen to provide free flat channel of such height H between said core and walls of the described cylindrical carcass of the invented cigarette holder, which guarantees existence in said channel of a well-developed Vortical Boiling regime of flow of the smoke at smoking.

FIG. 4 shows the schematics of the dense triangular lattice of segmental dimples. Signature feature of such lattices is the fact that the parameter of it is $a=3^{1/2}r$. It is important to maintain right orientation of lattice in regard to stream of fluid: just as it is shown in FIG. 4.

FIG. 5 shows an example of a well-developed Vortical Boiling regime of flow over a surface that is modified with the dense triangular lattice of segmental dimples. Generally said regime strongly depends on geometry of the channel, thermal characteristics of its walls and speed of smoke's flow.

Particularly, it is recommended to make each dimple as a segment of some imaginary sphere of radii R=1.61 mm and with its own radii r=1.2 mm and depth h=0.54 mm. All such dimples should be put in a dense triangular lattice with parameter of lattice a=2.08 mm. At the proper rate of flow of the streamlined flux of smoke over such lattice generates a coherent pattern of vortical jets between neighboring dimples, as it is shown in FIG. 5. This flow provides the ultimately low pressure drop and ultimately high index of heat exchange between the smoke and walls of the channel. As a result of said features the present invention provides full recuperation of the inhaled smoke up to the normal temperature of the smoker's body.

Said recuperation is achieved due to usage of materials for the cigarette holder that have high thermal conductivity and high heat capacity (aluminum, cooper, silver, gold, etc.). During the smoking and pauses between two consecutive smoking events, the heat accumulated by the cigarette holder is quickly delivered to the external surface of said cigarette holder due to high thermal conductivity of the used materials, so that the cigarette holder can be easily chilled by the natural convection with the ambient environment.

FIG. 6 shows the schematics of the entrance cover [003] of the invented cigarette holder.

FIG. 7 shows the schematics of the mouthpiece [004] of the invented cigarette holder. These two parts, being screwed on the ends of the described cylindrical carcass of the invented cigarette holder, are keeping entire construction in the reliable strength state, in one hand, and do provide a quick and easy disassembling of the entire construction in case of the need to clean of its inside surfaces.

FIG. 8 shows the schematics of the multichannel cigarette holder, when the idea of an insider core, like [002], is used for creation of multitude parallel channels for a smoke.

The foregoing descriptions of specific embodiments of the invention are presented for purposes of illustration and description. They are not intended to be exhaustive or to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications best fit to the particular use contemplated. It is intended that a scope of the invention be defined broadly by the Drawings and Specification appended hereto and to their equivalents. Therefore, the scope of the invention is in no way to be limited only by the following exemplary claims nor by any possible, adverse inference under the rulings of Warner-Jenkins Company, v. Hilton Davis Chemical, 520 US 17 (1997) or Festo Corp. V. Shoketsu Kinzoku Kogyo Kabushiki Co., 535 U.S. 722 (2002), or other similar case of law or subsequent precedent should not be made if such claims are amended subsequent to this Utility Patent Application.

Having thus described the invention what is claimed is:

1. A cigarette holder that provides full recuperation of the temperature of the smoke to the normal human body temperature comprising:

a first half-cylindrical external wall;

a second half-cylindrical external walls attachable to said first half-cylindrical external wall for forming an external cylindrical carcass;

said external carcass further forming a flat rectangular central notch milled out through an entire length of said cylindrical carcass through the entire length;

a central core that is held within said flat rectangular notch and attached between said flat rectangular central notch symmetrically through the entire length symmetrical within said flat rectangular central notch inside said cylindrical carcass and forming two flat rectangular smoke transportation channels formed between said core and first half-cylindrical external wall and said core and said second half-cylindrical external wall.

2. The cigarette holder of claim 1 wherein at least one inner surface of each said flat rectangular smoke transportation channel forms a triangular lattice of the segmental dimples.

3. The cigarette holder of claim 2, further comprising a triangular lattice of segmental dimples on opposing surfaces of said flat rectangular smoke transporting channel, so that each dimple has a mirror replica exactly opposing it.

4. The cigarette holder of claim 3, wherein said central core makes thermal contact with said first half-cylindrical external wall and said second half-cylindrical external wall.

5. The cigarette holder of claim 4, wherein said first half-cylindrical external wall, said second half-cylindrical external wall, and said central core are each made from a material selected from the group comprising: aluminum; steel; brass; bronze; copper; silver; gold; platinum; metals with high heat and thermal conductivity; alloys of steel;

alloys of brass; alloys of bronze; alloys of copper; alloys of silver; alloys of gold; alloys of platinum; and alloys of metals with high heat and thermal conductivity.

6. The cigarette holder of claim 3, wherein said first half-cylindrical external wall, said second half-cylindrical external wall, and said central core are each made from a material selected from the group comprising: aluminum; steel; brass; bronze; copper; silver; gold; platinum; metals with high heat and thermal conductivity; alloys of steel; alloys of brass; alloys of bronze; alloys of copper; alloys of silver; alloys of gold; alloys of platinum; and alloys of metals with high heat and thermal conductivity.

7. The cigarette holder of claim 6, further comprising:

a first end of said cylindrical carcass adapted for holding an end of a cigarette; and a second end of said cylindrical carcass, opposite said first end, having a mouthpiece.

8. The cigarette holder of claim 3, further comprising:

a first end of said cylindrical carcass adapted for holding an end of a cigarette; and a second end of said cylindrical carcass, opposite said first end, having a mouthpiece.

9. The cigarette holder of claim 2, further comprising:

a first end of said cylindrical carcass adapted for holding an end of a cigarette; and a second end of said cylindrical carcass, opposite said first end, having a mouthpiece.

10. The cigarette holder of claim 2, wherein said central core makes thermal contact with said first half-cylindrical external wall and said second half-cylindrical external wall.

11. The cigarette holder of claim 10, wherein said first half-cylindrical external wall, said second half-cylindrical external wall, and said central core are each made from a material selected from the group comprising: aluminum; steel; brass; bronze; copper; silver; gold; platinum; metals with high heat and thermal conductivity; alloys of steel; alloys of brass; alloys of bronze; alloys of copper; alloys of silver; alloys of gold; alloys of platinum; and alloys of metals with high heat and thermal conductivity.

12. The cigarette holder of claim 2, wherein said first half-cylindrical external wall, said second half-cylindrical external wall, and said central core are each made from a material selected from the group comprising: aluminum; steel; brass; bronze; copper; silver; gold; platinum; metals with high heat and thermal conductivity; alloys of steel; alloys of brass; alloys of bronze; alloys of copper; alloys of silver; alloys of gold; alloys of platinum; and alloys of metals with high heat and thermal conductivity.

13. The cigarette holder of claim 12, further comprising:

a first end of said cylindrical carcass adapted for holding an end of a cigarette; and a second end of said cylindrical carcass, opposite said first end, having a mouthpiece.

14. The cigarette holder of claim 1, further comprising:

a first end of said cylindrical carcass adapted for holding an end of a cigarette; and a second end of said cylindrical carcass, opposite said first end, having a mouthpiece.

15. The cigarette holder of claim 1, wherein said first half-cylindrical external wall, said second half-cylindrical external wall, and said central core are each made from a material selected from the group comprising: aluminum; steel; brass; bronze; copper; silver; gold; platinum; metals with high heat and thermal conductivity; alloys of steel; alloys of brass; alloys of bronze; alloys of copper; alloys of silver; alloys of gold; alloys of platinum; and alloys of metals with high heat and thermal conductivity.

16. The cigarette holder of claim 15, further comprising:

a first end of said cylindrical carcass adapted for holding an end of a cigarette; and a second end of said cylindrical carcass, opposite said first end, having a mouthpiece.

17. The cigarette holder of claim 1, wherein said central core makes thermal contact with said first half-cylindrical external wall and said second half-cylindrical external wall.

18. The cigarette holder of claim 17, further comprising:

a first end of said cylindrical carcass adapted for holding an end of a cigarette; and a second end of said cylindrical carcass, opposite said first end, having a mouthpiece.

19. The cigarette holder of claim 17, wherein said first half-cylindrical external wall, said second half-cylindrical external wall, and said central core are each made from a material selected from the group comprising: aluminum; steel; brass; bronze; copper; silver; gold; platinum; metals with high heat and thermal conductivity; alloys of steel; alloys of brass; alloys of bronze; alloys of copper; alloys of silver; alloys of gold; alloys of platinum; and alloys of metals with high heat and thermal conductivity.

20. The cigarette holder of claim 19, further comprising:

a first end of said cylindrical carcass adapted for holding an end of a cigarette; and a second end of said cylindrical carcass, opposite said first end, having a mouthpiece.

* * * * *